United States Patent [19]

Revnivtsev et al.

[11] Patent Number: 4,844,362

[45] Date of Patent: Jul. 4, 1989

[54] CONE CRUSHER

[75] Inventors: Vladimir I. Revnivtsev; Leonid P. Zarogatsky; Genrikh A. Denisov; Viktor V. Fedyakov, all of Leningrad, U.S.S.R.

[73] Assignee: Vsesojuzny Nauchno-Issledovatelsky I Proektny Institut Mekhanicheskoi Obrabotki Poleznykh Iskopaemykh, Leningrad, U.S.S.R.

[21] Appl. No.: 130,540

[22] PCT Filed: Jan. 19, 1987

[86] PCT No.: PCT/SU87/00004

§ 371 Date: Sep. 17, 1987

§ 102(e) Date: Sep. 17, 1987

[87] PCT Pub. No.: WO87/04371

PCT Pub. Date: Jul. 30, 1987

[51] Int. Cl.[4] ..... B02C 2/06

[52] U.S. Cl. ..... 241/210; 241/213; 241/215

[58] Field of Search ..... 241/207-216, 241/37

[56] References Cited

U.S. PATENT DOCUMENTS 3,837,585 9/1974 Decker et al. .
4,073,446 2/1978 Rundkvist et al. .

FOREIGN PATENT DOCUMENTS 1063455 12/1983 U.S.S.R. .
1209277 2/1986 U.S.S.R. .

OTHER PUBLICATIONS

A. S. Donchenko et al. . . . . Nedra, Moscow, p. 50.
Krupp, "Kubria—Kegelbrecher".

*Primary Examiner*—Mark Rosenbaum
*Attorney, Agent, or Firm*—Lilling & Greenspan

[57] ABSTRACT

A cone crusher includes outer and inner cones (2, 3) with a discharge slot (5) between them, a shaft (7) of the inner cone (3), a means for adjusting the size of the discharge slot (5) and a means for imparting gyrations to the inner cone (3). The means for adjusting the size of the discharge slot (5) is a reciprocation mechanism (12) and the means for imparting gyrations to the inner cone is an unbalanced vibrator (17).

3 Claims, 1 Drawing Sheet

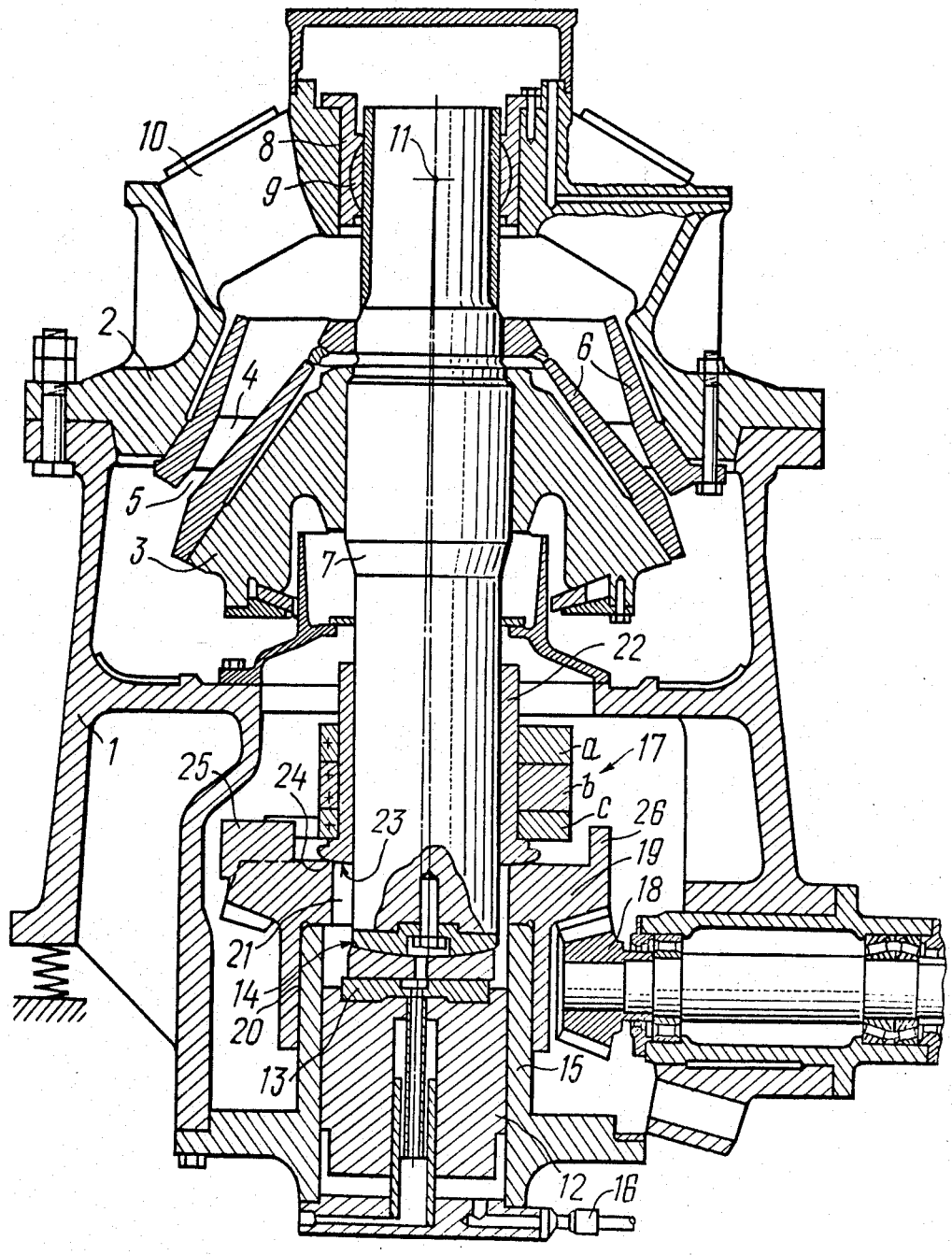
10
8
9
11
2
4
6
5
3
7
22
1
25
24
23
a
17
b
c
26
19
18
21
14
20
13
15
12
16

CONE CRUSHER

BACKGROUND OF THE INVENTION

1. Field of the Invention

The present invention relates to devices for crushing materials within a wide range of hardness and, more particularly, relates to gyratory or cone crushers.

2. Description of the Prior Art

Among the main operational characteristics of crushers is the fineness or coarseness of the crushing they perform and the feasibility of adjusting them up to a required particle size of crushed product. Highly desirable is stepping up the degree of automation of crushers, e.g. providing for their continuous performance with a stable throughput and product size. Stability of these characteristics of cone crushers is predominantly dependent on the stability of the size of the discharge opening or slot between the inner and outer cones, which is prone to significant variations, e.g. due to wearing out of the armored working surfaces of the cones. To maintain a desired size of the discharge opening, cone crushers are equipped, as a rule, with means for controlling the size of this discharge opening.

The feasibility of adjusting a cone crusher to a required product size is dependent on the design of the means imparting gyratory motion to the inner cone.

There is known a cone crusher (A. S. Donchenko et al., Spravochnik mekhanika rudoobogatitelnoi fabriki, 1975, Nedra Moscow, p.50) which includes a housing, an outer hollow cone attached to the housing by a threaded joint, an inner cone received within the hollow outer cone with a discharge slot defined therebetween, mounted for rotation about its axis and gyrations about a center belonging to the axis of the outer cone, a shaft extending coaxially with the inner cone and fast therewith, and means for imparting gyrations to the inner cone, mounted on the shaft for rotation thereabout and operatively connected with a drive through a bevel gear couple. The means for adjusting the size of the discharge slot in this cone crusher is the threaded joint of the outer cone with the housing, and the adjustment of the size of the slot is carried out by vertically displacing the outer cone relatively to the inner one by rotating the former in its threaded joint. However, this operation can be performed only with the crushing space having been emptied of the material being crushed, i.e. with the crushing operation discontinued, which adversely affects the throughput of the crusher.

The means for imparting gyrations to the inner cone in this known crusher includes a driven eccentric weight providing for a specific predetermined angle of nutation of gyrations of the inner cone, dependent on the degree of eccentricity of the eccentric weight, which, in its turn, defines the degree of compression of the material in the crushing space between the cones, and, hence, defined the actual degree of disintegration or crushing which in most cases is within 1:5.

When the degree of disintegration or crushing is to be varied, i.e. when the crusher is to be adjusted for a required product size, the driven eccentric weight in the crusher being described has to be replaced with another weight of a different eccentricity; in most cases the higher degree of crushing is paid for in terms of a lower throughput.

A variation of the degree of crushing, i.e. adjustment of a crusher to a required product size within a relatively wide range is possible in a crusher where the means for imparting gyrations to the inner cone includes an unbalanced vibrator mounted on the shaft of the inner cone with the aid of a sliding-contact bearing and operatively connected with the driven gear of the bevel gear couple through a flexible shaft, e.g. a universal-joint shaft extending coaxially with the outer cone (U.S. Pat. No. 4,073,446).

The provision in the crusher of the unbalanced vibrator permits replacement of the stable operative connections between the cones, characteristic of crushers with driven eccentric weights, by dynamic connections. This, in its turn, provides for the inner cone rolling directly along the outer cone in engagement therewith when no material is present therebetween. This kind of interaction of the cones provides for disintegrating a material in a thick layer, with the degree of crushing being as high as 1:20 and with the material being bulk-fed into the crusher directly from a feed hopper.

Furthermore, the unbalanced vibrator can be designed to feature a variable static moment, which provides for easily varying the degree of the crushing of a product, e.g. within a range from 1:4 to 1:20, without affecting the throughput of the crusher. A variation of the static moment of the unbalanced vibrator would vary the centrifugal force developed by the vibrator and, consequently, the crushing effort, which would vary the degree of deformation of the material, and ultimately the product size.

However, the means for adjusting the size of the discharge slot in the cone crusher being described is similar to its counterpart in the previously described cone crusher in that it also requires an interruption of the crushing operating and emptying of the crushing space for carrying out an adjustment of the discharge slot.

Finally, there is known a cone crusher comprising a housing, an outer hollow cone fixedly mounted in this housing, an inner cone received within the hollow outer cone with a discharge slot defined therebetween, mounted for rotation about its axis and for gyrations relative to a centre belonging to the axis of the outer cone, a shaft extending coaxially with the inner cone and fast therewith, means for adjusting the size of the discharge slot including a mechanism for axial reciprocation of the shaft, having its power member operatively connected with the free end of the shaft through a self-aligning spherical joint, and means for imparting gyrations to the inner cone, mounted on the shaft for sliding therealong and rotating thereabout, connected with a drive through a bevel gear couple of which the driven gear is arranged concentrically with the line of the motion of the actuating member of the reciprocation mechanism, the central bore of the driven gear being in excess of the diameter of the shaft (KRUPP, "Kubria-Kegelbrecher").

The means for imparting gyrations to the inner cone in this known crusher includes an eccentric bushing-mounted on the shaft of the inner cone with the aid of a sliding-contact bearing and fastened by its bottom end to the driven gear of the bevel gear couple. The means for adjusting the size of the discharge slot in the crusher, unlike the previously described crushers, is in the form of a reciprocation mechanism, i.e. of a hydraulic power cylinder of which the power member is operable for reciprocating the shaft of the inner cone and, hence, the inner cone itself with respect to the outer cone fixed in the housing, which varies the size of the discharge slot of the crusher. This adjustment does not necessitate the emptying of the crushing space between the cones of the material being handled, thus enhancing the conditions for controlling the process performed by the crusher with a relatively simple design of the latter. There is also a possibility for automating the operation of adjusting the size of the discharge slot by relatively simple means. However, this last-described crusher is not free from the drawbacks mentioned hereinabove in the description of the crusher with a driven eccentric weight.

It should be pointed out that the central arrangement of the hydraulic power cylinder axially of the outer cone precludes the incorporation in the last-described crusher of an unbalanced vibrator as the means for imparting gyrations to the inner cone, including in its drive the centrally arranged flexible driving shaft.

SUMMARY OF THE INVENTION

The object of the present invention is to provide a cone crusher where a means for imparting gyrations to the inner cone is a known unbalanced vibrator operatively connected to a drive of the crusher through connecting members providing for employing a mechanism for reciprocating the shaft of the inner cone along the axis of the outer cone as a means for adjusting the size of the discharge slot.

This object is attained by a cone crusher comprising a housing, a hollow outer cone fixed in the housing, an inner cone accommodated within the hollow outer cone with a discharge slot defined therebetween, the inner cone being mounted for rotation about its axis and for gyrations relative to a center belonging to the axis of the outer cone, and a shaft extending coaxially with the inner cone and fast therewith. Means are provided for adjusting the size of the discharge slot, including a mechanism for reciprocating axially said shaft, operatively connected by its power member with the free end of said shaft of the inner cone through a self-aligning spherical joint. Means are provided for imparting gyrations to the inner cone mounted on said shaft thereof for sliding therealong and rotating thereabout, operatively connected with a drive through a bevel gear couple of which the driven gear is mounted concentrically with the line of the motion of the power member of the reciprocation mechanism and has a central bore of a diameter in excess of the diameter of said shaft of the inner cone. In the cone crusher in accordance with the present invention the means for imparting gyrations to the inner cone includes an unbalanced vibrator having a spherical bearing surface, the central bore of the driven gear having thereabout a peripheral supporting spherical edge, adapted for operative interaction with the spherical bearing surface of the unbalanced vibrator to define therewith a self-aligning spherical joint, the end face of the driven gear carrying a driver adapted to engage the unbalanced vibrator for transmitting the driving torque thereto.

To enhance the performance reliability of the cone crusher, it is expedient that the center of the sphere defining the spherical joint of the unbalanced vibrator and the driven gear should coincide with the center of gyrations of the inner cone.

A cone crusher constructed in accordance with the present invention provides for dependable stabilization of a required adjusted size of the discharge slot and its adjustment both in automated and manual modes, permitting easy adjustment of the crusher to a required product size within a broad range of sizes without impairing the throughput, in a design both simple and reliable in operation.

BRIEF DESCRIPTION OF THE DRAWING

The present invention will be further described in connection with a presently preferred embodiment, with reference being made to the accompanying schematic drawing showing a sectional view of a cone crusher, in accordance with the invention.

DESCRIPTION OF THE PREFERRED EMBODIMENT

In the drawing, the cone crusher comprises a housing 1, a hollow outer cone 2 fast with the housing 1, an inner cone 3 accommodated within the hollow outer cone 2 and defining therewith a crushing space 4 and a discharge opening or slot 5 between the working surfaces of the cones 2 and 3, lined with an armor lining 6. The inner cone 3 is mounted on a shaft 7 extending coaxially with the inner cone 3 and fastened thereto. The projecting upper end of the shaft 7 is received in a guide bushing 8 defining a spherical joint 9 supported by the crosspiece 10 of the outer cone 2, so that the inner cone 3 is capable of rotation about its axis of symmetry and of gyrations about a center 11 which is the center of the spherical joint 9, belonging to the axis of the outer cone 2 and being situated substantially at the middle of the vertical dimension of the bushing 8. The cone crusher constructed in accordance with the present invention further comprises means for adjusting the size of the discharge slot 5, including a mechanism 12 for axial reciprocation of the shaft 7, the power member 13 of the mechanism 12 being operatively connected with the free bottom end of the shaft 7 through a self-centering spherical joint 14. The mechanism 12 for reciprocating the shaft 7 in the presently described embodiment includes a hydraulic power cylinder or jack mounted in a throat portion 15 of the housing 1 and having a connection 16 for supplying the working fluid into the working space of the hydraulic cylinder. The cone crusher still further comprises means for imparting gyrations to the inner cone 3, including an unbalanced vibrator 17 operatively connected with the drive (not shown) of the crusher through a bevel gear couple 18, 19 of which the driving gear 18 is coupled to the drive shaft and the driven gear 19 is journaled for rotation about the throat portion 15 of the housing 1 with the aid of a bearing 20, coaxially with the hydraulic cylinder of the reciprocation mechanism 12. The driven gear 19 has a central bore 21 of which the diameter exceeds the outer diameter of the shaft 7 to account for its displacement caused by gyrations of the inner cone 3. The unbalanced vibrator 17 is mounted on the shaft 7 with the aid of a cylindrical sliding-contact bearing 22 and has a variable static moment. It includes three unbalanced weights "a", "b" and "c" of which the weights "a" and "c" are mounted fixedly, while the weight "b" is rotatably adjustable with respect to the weights "a" and "c". The bottom end surface 23 of the cylindrical bearing 22 has a spherical shape, matching the spherical peripheral top edge 24 of the central bore 21 of the driven gear 19, so that the two spherical surfaces 23 and 24 define together a self-aligning spherical joint supporting the unbalanced vibrator 17. The center of the sphere defining the spherical surfaces 23, 24 making up this joint coincides with the center 11 of gyrations of the inner cone 3. The top face of the driven gear 19 carries a driver 25 adapted to engage the unbalanced vibrator 17 for transmitting the driving torque to it. The driver 25 also serves as a counterweight adapted to counterbalance the centrifugal force developed by the unbalanced vibrator 17 and by the gyrating inner cone 3. The top face of the driven gear 19 further has a rim 26 serving to limit the amplitude of gyrations of the inner cone 3.

The cone crusher embodying the present invention operates, as follows.

The drive transmits the driving torque through the bevel gear couple 18, 19 and driver 25 to the unbalanced vibrator 17 which starts revolving on the bearing 22 about the shaft 7. The rotation of the unbalanced vibrator generates a centrifugal force transmitted via the shaft 7 to the inner cone 3, driving the latter through successive gyrations about the center 11 belonging to the axis of the outer cone 2. A material to be crushed is bulk-fed into the crushing space 4 directly from a feed hopper (not shown). The gyrations of the inner cone 3 develop the process of crushing the material between the cones 2 and 3 in a thick layer. The level of the crushing effort applied to the material layer is adjusted by setting a required static moment of the unbalanced vibrator 17, by rotating the adjustable unbalanced weight "b" with respect to the fixed unbalanced weights "a" and "c" and fixing it in an adjusted position. In this manner the crusher being described is set for handling a material of any strength or hardness to a required product size, within a range of variation of the crushing degree or ratio from 1:4 to 1:20. The required size of the discharge slot 5 is set by adjusting vertically the inner cone 3, by operating the reciprocation mechanism 12. When being thus lifted or lowered, the shaft 7 moves substantially vertically inside the sliding-contact bearing 22 of the unbalanced vibrator 17. The latter, jointly with the shaft 7, gyrates on its supporting self-aligning spherical joint without destroying it, as the center of the sphere of the joint coincides with the center of gyrations of the inner cone 3. As the inner cone 3 in its gyrations also generates a centrifugal force, the sum of the centrifugal forces developed by the unbalanced vibrator 17 and the inner cone 3 would be constant with a predetermined set size of the discharge slot. Thus, a required throughput can be preset by selecting the required crushing effort by means of adjusting the static moment of the unbalanced vibrator 17 and setting the required size of the discharge slot 5. With no material to be crushed present between the cones 2 and 3, the inner cone 3 would roll in direct engagement with the outer cone 2 if the size of the discharge slot 5 is set below a permissible value. On the other hand, if the size of the discharge slot 5 exceeds a permissible value on account of the wear of the armor lining 6 of the cones 2 and 3, the unbalanced vibrator 17 would abut against the rim 26 of the driven gear 19, the centrifugal force developed by the driver 25 (with appropriate selection of its mass and angular position) counterbalancing the total centrifugal force generated by the unbalanced vibrator 17 and the inner cone 3.

It should be pointed out that the design of a cone crusher constructed in accordance with the invention provides for maintaining a preset size of the discharge slot 5 throughout the working duty of the crusher without interrupting its operation.

The invention can be utilized in ore treatment plants of concentrating mills in ferrous and nonferrous metallurgy.

We claim:

1. A cone crusher comprising a housing (1); hollow outer cone (2) fixed in said housing (1); an inner cone (3) accommodated within said hollow outer cone (2) and defining a discharge slot (5) therebetween, mounted for rotation about its axis and gyrations about a center (11) belonging to the axis of said outer cone (2); a shaft (7) extending coaxially with said inner cone (3) and fixed therewith; means for adjusting the size of the said discharge slot (5), including a mechanism (12) for reciprocating said shaft (7) axially of said outer cone (2), having a power member (13) operatively connected with a free end of said shaft (7) of said inner cone (3) through a self-aligning spherical joint (14), and means for imparting gyrations to said inner cone (3), mounted on said shaft (7) for sliding therealong and rotating thereabout, operatively connected with a drive through a bevel gear couple (18, 19) of which a drive gear (19) is arranged concentrically with the line of travel of said power member (13) of said reciprocation mechanism (12) and has a central bore (21) whose diameter exceeds the diameter of said shaft (7) of said inner cone (3), said means for imparting gyrations to said inner cone (3) being an unbalanced vibrator (17) having a spherical bearing surface (23), said central bore (21) of said driven gear (19) having thereabout a peripheral supporting spherical edge adapted for operative interaction with said spherical bearing surface (23) of said unbalanced vibrator (17) to define therewith a self-aligning spherical joint, an end face of said driven gear (19) carrying a driver (25) adapted to engage said unbalanced vibrator (17) for transmitting the driving torque thereto.

2. A cone crusher as claimed in claim 1, wherein the center of the sphere defining the spherical joint between said unbalanced vibrator (17) and said drive gear (19) coincides with the center (11) of gyrations of said inner cone (3).

3. A cone crusher as claimed in claim 1, wherein said driven gear (19), on the side of its casing diametrically opposite to said driver (25), is provided with an amplitude arrester of said inner cone (3) made as a rim (26).

* * * * *